US005653025A

United States Patent [19]

Cheng et al.

[11] Patent Number: 5,653,025

[45] Date of Patent: Aug. 5, 1997

[54] THERMALLY ASSISTED SHAVING SYSTEM

[75] Inventors: Larry Cheng, Mountain View, Calif.; Tony J. Lillios, Orange, Conn.; Jason M. B. Quintana, Vancouver, Wash.

[73] Assignee: Warner-Lambert Company, Morris Plains, N.J.

[21] Appl. No.: 600,316

[22] Filed: Feb. 13, 1996

Related U.S. Application Data

[63] Continuation of Ser. No. 59,154, May 7, 1993, abandoned.

[51] Int. Cl.[6] ..... B26B 19/48

[52] U.S. Cl. ..... 30/41; 30/41.5; 30/43.91; 30/140

[58] Field of Search ..... 38/41.5, 41.6, 38/41, 43.91, 140, 34.2

[56] References Cited

U.S. PATENT DOCUMENTS

| | | | |
|---|---|---|---|
| 2,164,581 | 7/1939 | Ewald | 30/41.5 |
| 3,364,568 | 1/1968 | Lowy | 30/41.5 |
| 3,368,277 | 2/1968 | Ve Vea | 30/41.5 |
| 4,044,463 | 8/1977 | Tietjens | 30/34.2 |
| 4,228,587 | 10/1980 | Bennett | 30/41 |
| 4,563,814 | 1/1986 | Trichell et al. | 30/41.5 |
| 4,733,468 | 3/1988 | Zadro | 30/41.5 |
| 5,000,719 | 3/1991 | Motta . | |
| 5,337,478 | 8/1994 | Cohen et al. | 30/41.5 |
| 5,394,777 | 3/1995 | Kozikowski . | |

FOREIGN PATENT DOCUMENTS 9305930 4/1993 WIPO .

OTHER PUBLICATIONS

'Vibration—proof seal lets shaver operate wet or dry' Machine Design, vol. 54, No. 16, Jul. 1, 1982, p. 75.

*Primary Examiner*—Maurice T. Rachuba
*Attorney, Agent, or Firm*—Charles W. Almer

[57] ABSTRACT

A battery-operated thermal shaver is provided which includes an impeller for directing a stream of heated air to the line of contact between a razor blade and the hair to be cut by the shaver. The impeller is a fan located within an air chamber of the shaver which draws ambient air into the chamber and directs it past a heating element to raise the temperature of the air to 120°–170° F. The impeller then exhausts the heated air through an exhaust port and into proximity with the razor blade. The fan is operated by a motor, having a drive shaft, which is protected against liquid penetration by a liquid barrier. The liquid barrier is a reservoir formed in the base of the fan for holding material immiscible in liquids. During operation, the drive shaft of the motor rotates the impeller while encased within the liquid barrier.

21 Claims, 3 Drawing Sheets

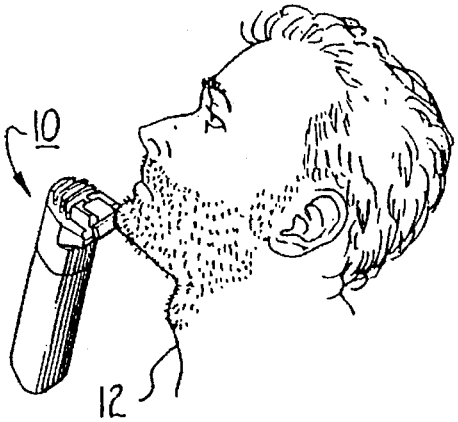
Fig. 1
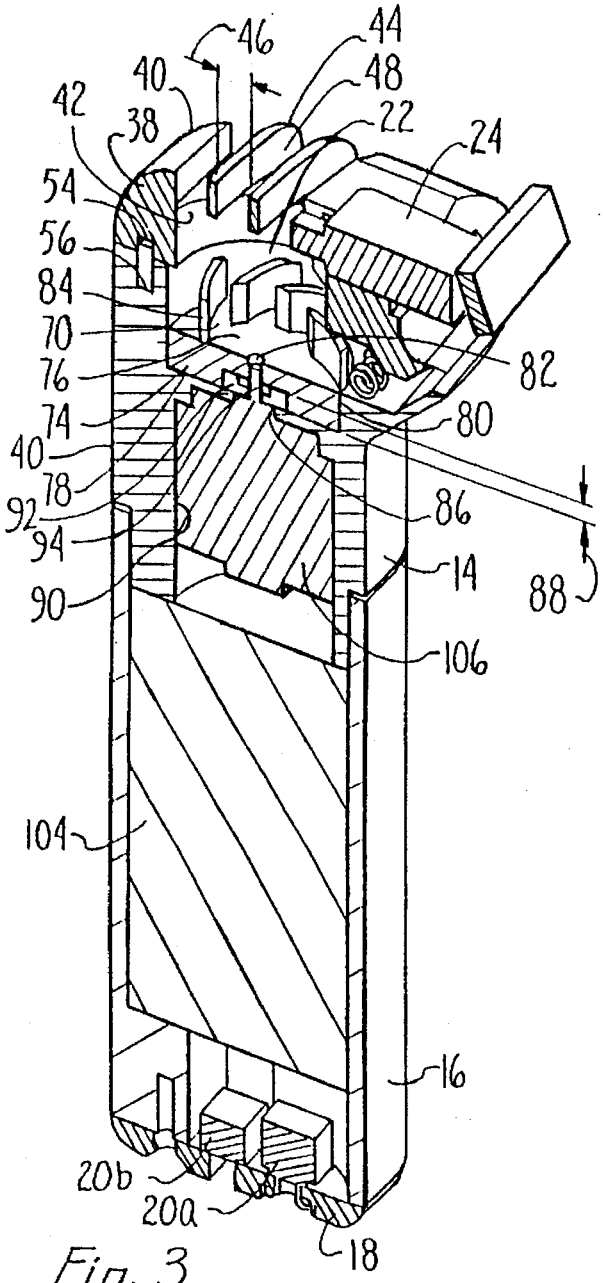
Fig. 3
Fig. 2
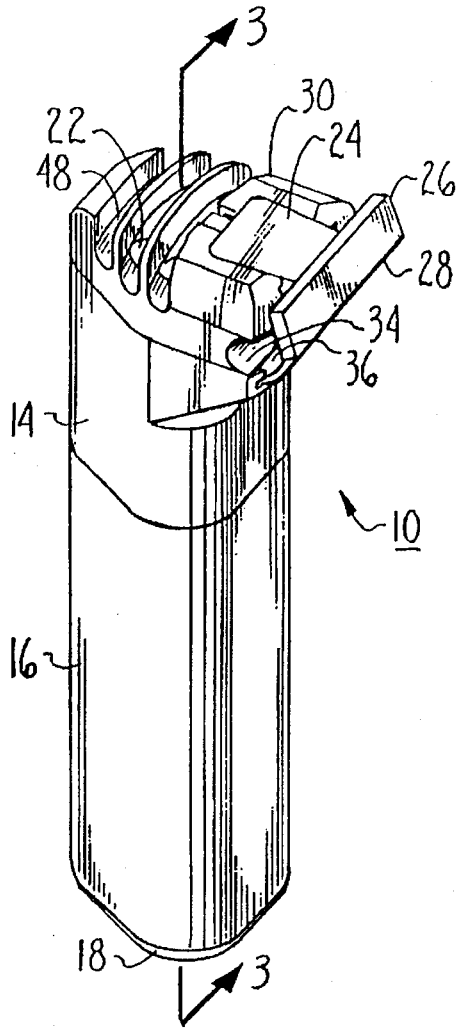

THERMALLY ASSISTED SHAVING SYSTEM

This application is a continuation of Ser. No. 059,154, filed May 7, 1993, now abandoned.

FIELD OF THE INVENTION

The present invention pertains generally to hand held shavers using a razor blade to cut hair. More particularly, the present invention pertains to battery operated rechargeable shavers. The present invention is particularly, but not exclusively, useful for delivering a stream of heated air into proximity with the razor blade and the hair to be shaved.

BACKGROUND OF THE INVENTION

For almost every shaving operation it is known that hair is more easily cut when it is heated. Additionally, it is known that heating a skin surface which is being shaved helps soothe and comfort the skin. The advantages of applying heat both to the hair and to the surface of the skin to be shaved are important to any shaving process.

In a typical shaving process using a razor blade, the cutting edge of the blade is drawn across the skin surface to cut hair in the path of the blade. Heat is applied generally to the skin surface by applying hot water or hot shaving creme. The usefulness of heat applied in either such manner is transitory. Both the water and the shaving creme cool between commencement and completion of shaving, a process lasting approximately 7–9 minutes. Availability of hot shaving creme is impractical in noncommercial environments. A cold or room temperature hair softening agent, such as shaving cream or lotion, may also be applied on the surface. Such a procedure produces a close shave because the blade is in direct contact with both the hair and the skin surface. However, the very closeness of the shave increases the possibilities of irritation to the skin, as is well known. The present invention recognizes that many problems normally associated with shaving with a razor blade can be avoided if the hair and skin surface to be shaved are properly heated immediately before the razor blade cuts the hair.

As suggested above, shaving comfort is in part a function of heat. Shaving comfort is inversely a function of drag, or resistance to the blade caused by the skin and the hair to be cut. The area of contact between the hair and the skin is limited because of the fineness of both the hair and the cutting edge of the razor blade. Providing heat to hair in the proximity of the cutting blade with each stroke of the shaver helps overcome this problem. A limitation on the use of heat to enhance shaving is the acceptable range of temperature for comfort. The comfort range for shaving is known to be generally limited to 120°–170° F.

Heating ambient air and directing the heated air into proximity with both a razor blade mounted on the shaver, and the hair to be cut, pose additional significant problems. The problems are caused in part by the presence of water and other liquids present during shaving. Water may envelop the entire shaver when the user washes or rinses the shaver and the razor blade. Debris generated by the shaving process, including cut hair, shaving creme, and water, must be directed away from the heated air. Otherwise, the debris would affect the temperature of the air being directed into proximity with the razor blade. Further, the debris cannot be allowed to inhibit the flow of heated air from the shaver.

Another problem involves the process of heating air in the presence of liquids, including water. The present invention uses a rechargeable battery mounted in the handle to both operate a motor to rotate a fan, and to energize a heating element in the shaver to heat the ambient air. If the motor is not protected from liquid penetration, the motor could be rendered useless every time water or other liquids seep into the motor. Likewise, the battery must be kept dry during operation. The present invention solves these problems. The present invention provides a hollow recess in the handle to house the battery and motor in isolation from the other components of the shaver. The present invention also provides a barrier against liquid penetration into the motor and battery compartment.

In light of the above, it is an object of the present invention to provide a shaving system which is able to achieve a comfortable shave. It is another object of the present invention to heat hair immediately before a razor blade cuts the hair. It is yet another object of the present invention to provide a thermally enhanced shaver which will heat an area of skin without irritating the skin. It is still another object of the present invention to provide a thermally enhanced shaver which uses hot air to reduce the sensation of discomfort during shaving. Yet another object of the present invention is to provide a thermally enhanced shaver which is relatively easy to manufacture and which is comparatively cost effective.

SUMMARY OF THE INVENTION

A thermal shaver is provided to reduce drag, and the consequent discomfort of shaving, by softening hair to be cut with heated air just before a razor blade attached to the shaver cuts the hair. In accordance with the present invention, such a shaver comprises a housing formed with an air chamber. The air chamber has an air intake and an exhaust port. A fan is located in the air chamber between the air intake and the exhaust port. A heating element is also located in the air chamber. Air at ambient temperature enters the air chamber through the air intake. The fan draws the unheated air across the heating element which selectively heats the air to a temperature range of 120°–170° F., and directs the heated air through the exhaust port. The exhaust port delivers heated air to the proximity of a cutting edge of a razor blade mounted on the shaver. In operation, the temperature range of the heated air is 120°–170° F. which, as is well known in the art, is the optimum range of temperature to enhance shaving comfort.

Any one of a variety of commercially available razor blades and razor blade cartridges well known in the art may be mounted on the shaver. To collect the typical debris of shaving, namely cut hair and shaving creme, a channel is provided in the shaver housing which can be rinsed during operation. The channel also prevents clogging of the exhaust port.

The handle of the thermally assisted razor of the present invention is hollow and is sized to hold a rechargeable battery and a motor. The battery energizes the motor and the heating element. The motor has a drive shaft engageable with the fan in the housing. The drive shaft rotates the fan.

The present invention also provides a liquid barrier between the fan and the motor. The barrier precludes seepage of liquids along the drive shaft of the motor into the motor during operation of the shaver. The barrier thus permits washing and rinsing of the shaver during operation of the shaver. For purposes of the present invention, the liquid barrier is a reservoir which is filled with a material that is immiscible in liquids. The drive shaft of the motor protrudes from the motor and through the reservoir for engagement with the fan.

The novel features of this invention, as well as the invention itself, both as to its structure and its operation, will be best understood from the accompanying drawings, taken in conjunction with the accompanying description in which similar reference characters refer to similar parts, and in which:

BRIEF DESCRIPTION OF THE DRAWINGS

FIG. 1 is a perspective view of the thermal shaver shown being used by a person;

FIG. 2 is perspective view of the assembled shaver in an operational configuration;

FIG. 3 is cross-sectional view of the shaver as seen along the line 3—3 as shown in FIG. 2;

DESCRIPTION OF PREFERRED EMBODIMENTS

Figure 4:
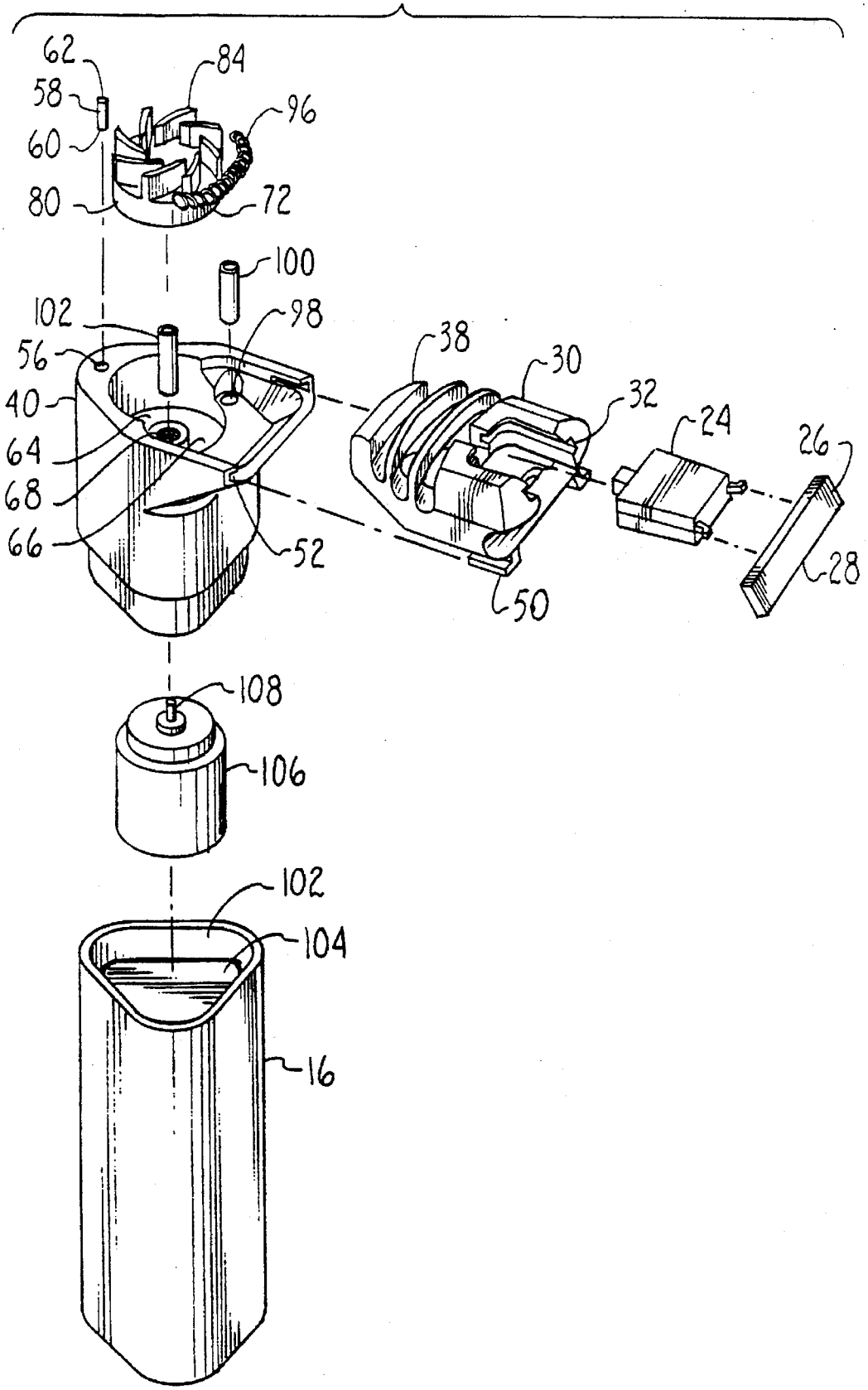
FIG. 4 is a perspective exploded view of the shaver.

Referring initially to FIG. 1, the thermal shaver of the present invention is shown and generally designated 10, and is shown operatively positioned against the face of a male person 12.

Referring now to FIG. 2, it will be seen that shaver 10 comprises a housing 14 and a handle 16. As shown by cross-reference between FIGS. 2 and 3, an end cap 18 is attached to handle 16 to provide access to a recharging jack 20*a* and a power off-on switch 20*b*. As shown in FIG. 2, housing 14 is formed with an air intake 22 for drawing ambient air into housing 14. A connector 24 is mounted adjacent air intake 22 of housing 14. A razor cartridge 26, having a cutting edge 28, is engaged with connector 24. As shown by cross-reference between FIGS. 2 and 4, a support member 30, formed with a plurality of notches 32, is attached to housing 14. Connector 24 is slidably engageable with notches 32 of support member 30. A channel 34 for temporarily collecting shaving debris between strokes of the shaver 10 is formed in housing 14 and is aligned substantially with the longitudinal axis of cartridge 26. An exhaust port 36 for directing air out of housing 14 is formed in housing 14 adjacent channel 34 and is substantially parallel to channel 34.

As can be seen in cross-reference between FIGS. 3 and 4, housing 14 further comprises an upper body 38 and a lower body 40. As is perhaps best shown in FIG. 3, the preferred embodiment of air intake 22 in upper body 38 is a substantially circular opening 42 through upper body 38. A plurality of vanes 44 are formed across air intake 22. Vanes 44 are separated from each other by a plurality of distances 46 forming a plurality of slots 48 as shown. Slots 48 are sufficiently separated from each other by distances 46 to permit ambient air to enter housing 14 through air intake 22, but sufficiently close to each other to preclude person 12 from inserting fingers through air intake 22 into housing 14.

As further shown in cross-reference between FIGS. 3 and 4, upper body 38 is formed with a plurality of slides 50, and lower body 40 is formed with a plurality of grooves 52. Slides 50 are slidably engageable with grooves 52 to attach upper body 38 to lower body 40. Upper body 38 is formed with one or more first cylindrical shafts 54, and lower body 40 is formed with one or more second cylindrical shafts 56. First cylindrical shaft 54 and second cylindrical shaft 56 are formed for holding a detent pin 58 having a lower end 60 and upper end 62. When upper body 38 is engaged with lower body 40, upper end 62 of detent 58 engages first cylindrical shaft 54 in upper body 38 to secure upper body 38 to lower body 40.

As shown in FIG. 4, lower body 40 is formed with a substantially cylindrical well 64 having a base 66 formed with a circular hole 68 through base 66. As can perhaps better be seen in FIG. 3, engagement of upper body 38 with lower body 40 forms an air chamber 70 in housing 14, and positions air intake 22 in fluid communication with exhaust port 36.

As also shown in FIG. 4, a fan 72 is mountable in well 64 of lower body 40 of housing 14. As best shown in FIG. 3, fan 72 includes a cylinder 74 having a first end surface 76, a second end surface 78, and an annular wall 80 between first end surface 76 and second end surface 78. Cylinder 74 is formed with a bore 82 substantially aligned with the longitudinal axis of cylinder 74. As shown in FIG. 4, a plurality of fan blades 84 are attached to first end surface 76 of cylinder 74. Each of the plurality of fan blades 84 extends from annular wall 80 toward the longitudinal axis of cylinder 74. In the preferred embodiment of the present invention, eight arcuate blades 84 are attached to first end surface 76 of cylinder 74.

Figure 5:
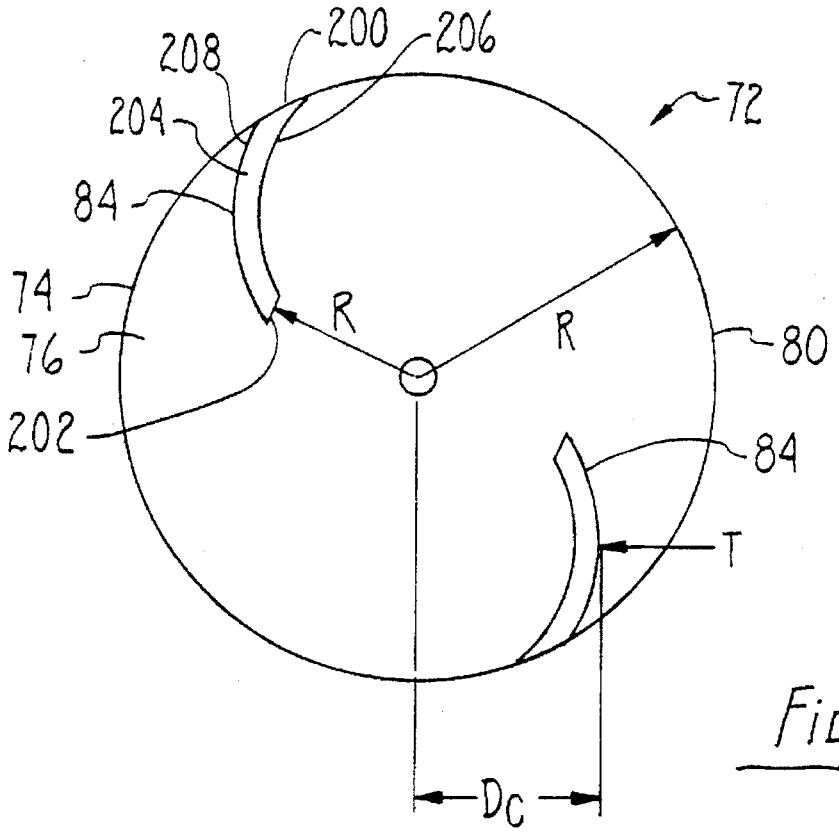
FIG. 5 is a top view of the fan showing only two arcuate blades.
Figure 6:
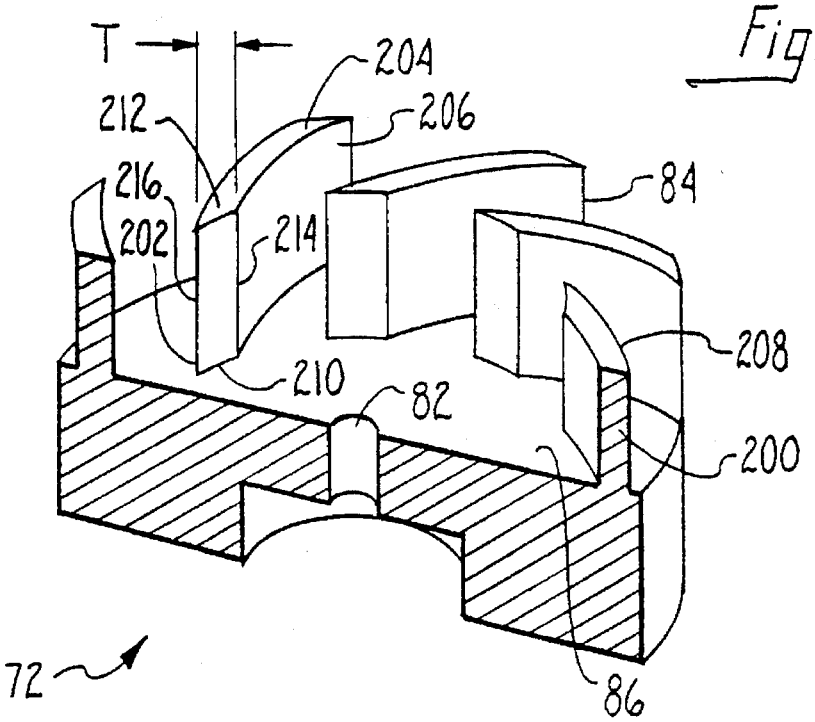
FIG. 6 is a perspective view of a portion of the fan shown with a plurality of arcuate blades.

Referring now by cross-reference between FIGS. 5 and 6, two of a plurality of arcuate blades 84 are shown formed on first end surface 76 of cylinder 74. Each arcuate blade 84 is formed with a wall end 200, an inner end 202, and a top end 204. Each arcuate blade also is formed with an inner curved wall 206 and an outer curved wall 208. The uniform distance between inner curved wall 206 and outer curved wall 208 is a distance T. As perhaps shown best in FIG. 6, inner end 202 is substantially perpendicular to first end surface 76 of cylinder 74. Inner end 202 is formed with a surface edge 210, and top edge 212, an inner edge 214, and an outer edge 216. Cylinder 74 also is shown with bore 82. The outer radius from the center of bore 82 to annular wall 80 of cylinder 74 is a distance $R_o$. The inner radius from the center of bore 82 to the center of surface edge 210 of inner end 202 of arcuate blade 84 is a distance $R_i$. The center distance between the center of outer edge 216 along a line substantially perpendicular to an outer radius $R_o$ is a distance $D_c$. In the preferred embodiment of the present invention the ratio of distance $R_i$ to distance $R_o$, wherein $R_i$ is the numerator, is within a range of 0.400 to 0.800. Further, in the preferred embodiment of the present invention the ratio of the distance $D_c$ to the distance $R_o$, wherein $D_c$ is the numerator, is within a range of 0.446 to 0.846. In addition, in the preferred embodiment of the present invention the ratio of the dimension T to the distance $R_o$, wherein the dimension T is the numerator, is within the range of 0.08 to 0.12. Arcuate blades 84 are formed with inner radii percentages of 0.600, center distance percentages of 0.650, and blade radius percentages of 1.000. However, as will be obvious to anyone of ordinary skill in the art, to achieve an air flow of approximately 0.5 cfm to produce a comfortable and soothing sensation on the skin of the user of the present invention, fan blades 84 .may be formed in various permutations, shapes and numbers of blades.

As is shown in FIG. 3, cylinder 74 of fan 72 is formed with a cavity 86 in second end surface 78 of cylinder 74. Cavity 86 extends a distance 88 toward first end surface 76 and is aligned substantially longitudinal to bore 82 in cylinder 74. Cavity 86 has a diameter greater than the diameter of bore 82.

FIG. 3 also shows that lower body 40 is formed with a substantially cylindrical drum 90. Drum 90 is formed with a substantially cylindrical reservoir 92 and a substantially cylindrical passageway 94. The circumference of reservoir 92 is greater than the circumference of passageway 94. The circumference of passageway 94 is substantially the same as the circumference of bore 82 in cylinder 74 of fan 72.

As shown in FIG. 4, a heating element 96 is mounted in chamber 70. Lower body 40 of housing 14 is formed with a plurality of cylindrical pin pockets 98 for securing element 96 with a plurality of pins 100. In the preferred embodiment of heating element 96 for the present invention, heating element 96 is energized by 7 amps of current through an element of 0.5 ohm to preclude the power generated from exceeding 140 watts per inch squared. However, as will be obvious to one of ordinary skill in the art, heating element 96 may be designed to have various permutations of current, resistance and power.

As can best be seen in cross-reference between FIGS. 3 and 4, handle 16 is formed with a hollow recess 102 sized for holding a battery 104 and a motor 106. Battery 104 energizes heating element 96 and motor 106. In the preferred embodiment of the present invention, the battery is a rechargeable nickel-cadmium (NiCad) battery well known in the art. However, as will be appreciated by those of ordinary skill in the art, any number of batteries may be used in connection wit the present invention. In the preferred embodiment of the present invention, motor 106 includes a drive shaft 108 extending from motor 106 through circular hole 68 in base 66 of well 64, and through cylindrical passageway 94 in drum 90, and through reservoir 92, and into bore 82 in fan 72. Reservoir 92 is filled with a liquid to provide a liquid barrier between fan 72 and housing 14. In operation, drive shaft 108 of motor 106 rotates fan 72 to direct ambient air across heating element 96 to heat the air, and to direct the heated air through exhaust port 36 into proximity to cutting edge 28 of razor cartridge 26.

While the particular Thermally Assisted Shaving System as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

We claim:

1. A thermal shaver, comprising:

a housing formed with an air chamber having an air intake and an air exhaust port;

a fan mounted in said air chamber;

a heating element mounted in said air chamber;

a razor blade for shaving hair, said razor blade being externally mounted on said housing in proximity to said exhaust port;

a handle attached to said housing;

means for establishing a liquid barrier located between said fan and said housing; and a motor mounted in said handle for rotating said fan to draw air through said air chamber and over said heating element to pass heated air from said exhaust port and into proximity with said blade.

2. A shaver as recited in claim 1, wherein said air intake is in fluid communication with said exhaust port.

3. A shaver as recited in claim 1, further comprising means for energizing said heating element and said motor.

4. A shaver as recited in claim 3, wherein said energizing means is a battery.

5. A shaver as recited in claim 1, wherein said housing includes an upper body formed with a plurality of slides, and a lower body formed with a plurality of grooves, said slides of said upper body being slidably engageable with said grooves of said lower body.

6. A shaver as recited in claim 1, wherein said heating element includes a single element coil.

7. A shaver as recited in claim 6, wherein said heating element includes a multi-element coil.

8. A shaver as recited in claim 6, wherein said heating element is energized to achieve a power density of less than 150 watts per square inch.

9. A shaver as recited in claim 6, wherein said heating element is energized by between 5 to 7 amps of current.

10. A shaver as recited in claim 6, wherein said heating element further comprises at least one resistor of between 0.1 and 0.9 ohm.

11. A shaver as recited in claim 6, wherein said heating element is detachable from said shaver.

12. A shaver as recited in claim 1, wherein said liquid barrier forming means includes a material immiscible in a liquid.

13. A shaver as recited in claim 12, wherein said material is a petroleum based gel.

14. A shaver as recited in claim 12, wherein said material immiscible in a liquid is held within a substantially cylindrical reservoir formed in said fan for holding said material.

15. A shaver as recited in claim 14, wherein said motor includes a drive shaft engageable with said fan.

16. A shaver as recited in claim 15, wherein said drive shaft extends through said reservoir for preventing liquid infiltration of said motor during operation and rinsing of said shaver.

17. A shaver as recited in claim 14, wherein said fan includes a cylinder having a first end surface, a second end surface, and an annular wall therebetween, said cylinder being formed with a bore through said cylinder substantially aligned with the longitudinal axis of said cylinder, said first surface having a plurality of arcuate blades attached to said first surface with each said blade extending between said annular wall and said longitudinal axis.

18. A shaver as recited in claim 17, wherein said fan includes at least one fan blade formed on said first surface of said cylinder.

19. A shaver as recited in claim 17, wherein said cylinder is formed with a circular cavity in said second end surface extending a distance toward said first end surface, said cavity being substantially aligned with said bore through said cylinder and having a diameter greater than the diameter of said bore.

20. A shaver as recited in claim 19, wherein said reservoir has a circumference greater than the circumference of said circular passageway.

21. A shaver as recited in claim 2, wherein said housing is formed with a channel in proximity to said exhaust port for temporarily collecting shaving debris, said channel being substantially parallel to said exhaust port.

* * * * *